US007360881B2

(12) United States Patent
Hagen et al.

(10) Patent No.: US 7,360,881 B2
(45) Date of Patent: Apr. 22, 2008

(54) FLUID CONTAINER HAVING AIR PASSAGEWAY

(76) Inventors: David M. Hagen, 1000 NE. Circle Blvd., Corvallis, OR (US) 97330-4239; John A Myers, 1000 NE. Circle Blvd., Corvallis, OR (US) 97330-4239

( * ) Notice: Subject to any disclaimer, the term of this patent is extended or adjusted under 35 U.S.C. 154(b) by 373 days.

(21) Appl. No.: 11/176,030

(22) Filed: Jul. 6, 2005

(65) Prior Publication Data

US 2007/0008389 A1 Jan. 11, 2007

(51) Int. Cl.
*B41J 2/175* (2006.01)

(52) U.S. Cl. ..... 347/86; 347/87

(58) Field of Classification Search ..... 347/85, 347/86, 87

See application file for complete search history.

(56) References Cited

U.S. PATENT DOCUMENTS 5,025,271 A * 6/1991 Baker et al. ..... 347/87
5,280,299 A * 1/1994 Saikawa et al. ..... 347/87
5,671,001 A 9/1997 Elliot
5,936,650 A 8/1999 Ouchida
6,086,192 A * 7/2000 Kurata et al. ..... 347/86
6,325,498 B1 * 12/2001 Higuma et al. ..... 347/86
6,386,678 B1 5/2002 Michael
6,390,593 B1 5/2002 DeRoos
6,464,346 B2 10/2002 Otis, Jr.
6,554,413 B2 * 4/2003 Kubota ..... 347/87
6,623,098 B2 9/2003 Davis
6,652,080 B2 11/2003 Childs
6,698,872 B2 * 3/2004 Hou et al. ..... 347/86
6,722,752 B2 4/2004 Davis
6,773,097 B2 8/2004 Dowell
6,776,479 B2 8/2004 Ardito
6,890,068 B2 5/2005 Kawamura
2002/0008744 A1 1/2002 Otis, Jr.
2003/0043240 A1 3/2003 Dowell
2003/0081089 A1 5/2003 Kawamura

* cited by examiner

*Primary Examiner*—Anh T. N. Vo

(57) ABSTRACT

A container includes a housing forming at least one chamber therein, a fluid conduit having a fluid opening extends into the chamber, and a fluid holding member is arranged within the chamber over the fluid opening. The fluid holding member leaves at least one air pocket within the chamber adjacent to the fluid conduit. When the fluid holding member is at least partially filled with a fluid it will have at least one wetted portion and at least one non-wetted portion. The wetted portion is fluidically coupled to the fluid conduit. The container also includes at least one feature within the chamber to provide an air passageway that allows air movement between the air pocket and at least the non-wetted portion.

22 Claims, 4 Drawing Sheets

(A)

(B)

(C)

FLUID CONTAINER HAVING AIR PASSAGEWAY

BACKGROUND

One very popular type of printing device is the inkjet printer. Some inkjet printers use a replaceable fluid container to supply ink and/or other fluids to a fluid ejection mechanism to print onto a medium. The fluid container and fluid ejection mechanism are sometimes integrated together into a single replaceable unit that may be referred to as a pen or print cartridge. The fluid ejection mechanism may include, for example, a printhead that selectively deposits ink or other fluids onto a print medium, such as paper, through an array of nozzles. Such fluid ejection may be initiated in the printhead, for example, using thermal or piezoelectric action.

A fluid container may include one or more internal chambers that act as reservoirs for one or more fluids. A fluid holding member may be arranged within a chamber to hold the fluid in a manner that allows it to be selectively ejected through the printhead. The fluid holding member provides a backpressure that usually prevents the fluid from simply draining or drooling out of the printhead nozzles. By way of example, certain fluid holding members include fluid-absorbing foam material.

Fluid stored in the fluid holding member may be provided to the printhead through a fluid conduit. The fluid conduit, which may be referred to as a standpipe, extends into the chamber and provides an opening that contacts a surface of the fluid holding member. The fluid conduit may also include a filter or screen in contact with the fluid holding member.

The fluid container may also include an air vent that allows air pressure within a chamber to equalize or otherwise adjust with the external atmosphere's pressure. Such an air vent also allows for additional air to enter into the chamber during printing as the fluid therein is consumed through ejection.

Air or other gas that is trapped or otherwise held inside the fluid container may affect the operation of the fluid container as the pressure of the trapped air changes. For example, in certain print cartridges increased pressure of trapped air may affect the backpressure provided by the fluid holding member such that fluid may leak or drool out of the printhead.

BRIEF DESCRIPTION OF THE DRAWINGS

The accompanying drawings illustrate various embodiments of the present invention and are a part of the specification. The illustrated embodiments are merely examples of the present invention and do not limit the scope of the invention.

DETAILED DESCRIPTION

The illustrative drawings shown and described herein are simplified depictions (not to scale) showing some of the features that may be provided in a fluid container for a printing device. These simplified drawings are not intended to limit the applicability or scope of the appended claims to more or less complex fluid containers.

Figure 1:
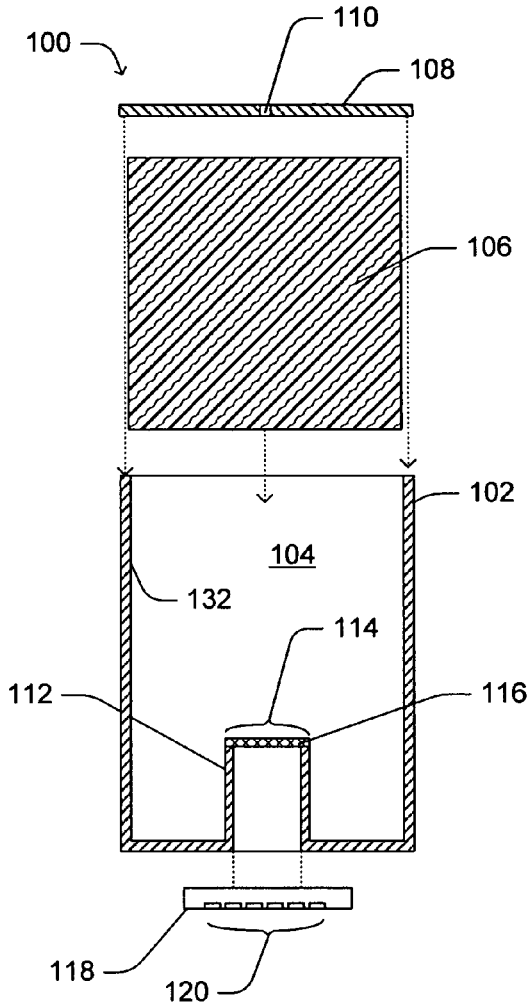
Fig. 1 (Prior Art)
FIG. 1A is an illustrative exploded-view diagram depicting, in cross-sectional view, certain features of an exemplary fluid container in the form of a print cartridge.
FIG. 1B shows two exemplary fluid containers, as in FIG. 1A, illustrating two differently shaped fluid conduits within the fluid container.
FIG. 1C is an illustrative cross-sectional diagram of the assembled fluid container in the form of a print cartridge of FIG. 1A.
Figure 1:
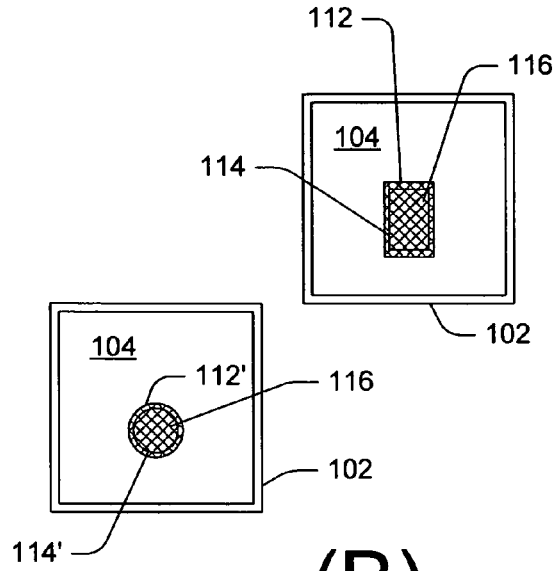
Fig. 1 (Prior Art)
Figure 1:
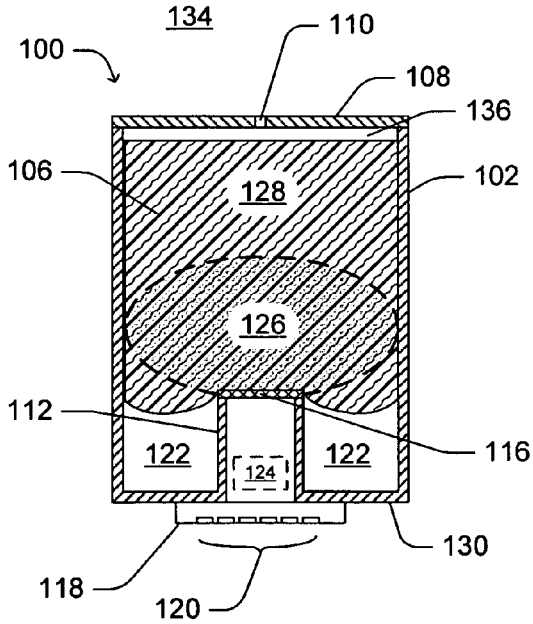
Fig. 1 (Prior Art)

FIG. 1A is an illustrative exploded-view diagram depicting, in cross-sectional view, certain features of an exemplary fluid container 100 in the form of a print cartridge. Container 100 includes a housing 102 forming at least one chamber 104 therein. A fluid holding member 106 is provided for insertion into chamber 104.

Fluid holding member 106 may include, for example, one or more materials and/or parts that accept, hold, and release fluid(s) as desired for proper operation. In certain implementations, fluid holding member 106 includes foam or the like providing a controlled capillary force. Such materials and arrangements are well known, for example, see U.S. Pat. No. 4,771,295 issued to Baker et al. In this example a lid 108 is provided to further define chamber 104 when attached to housing 102. Here, an air vent 110 extends through lid 108. While not shown, air vent 110 may take a serpentine route (e.g., a labyrinth path), as is well known.

A fluid conduit 112 extends inwardly into chamber 104. While not necessary, in this example, fluid conduit 112 is at least partially integrally formed with housing 102. Fluid conduit 112 includes a fluid opening 114 through which fluid in fluid holding member 106 may be drawn during printing. Here, a screen or filter 116 is also shown as being arranged over or otherwise covering fluid opening 114. Filter 116 tends to prevent debris and/or air from entering fluid conduit 112. Filter 116 may also act to keep a fluid flow path through fluid conduit 112 clear by preventing intrusion of fluid holding member 106 into the fluid conduit 112.

Fluid that is drawn from fluid holding member 106, through filter 116 (if present), enters into fluid conduit 112 and is supplied to a fluid ejection mechanism 118. Fluid ejection mechanism 118, in this example, includes a printhead 118 having a plurality of nozzles 120. Those skilled in the art will recognize that fluid ejection mechanism 118 may include other components (not shown) such as circuitry, interconnects, other fluid chambers, channels, conduits, etc.

The fluid in fluid conduit 112 may be held at less than atmospheric pressure to prevent the fluid from drooling out nozzles 120. As is well understood, this negative relative pressure, or backpressure, must not be so great that air is pulled into the interior of fluid ejection mechanism 118 (e.g., firing chambers (not shown) associated with the nozzles), thereby emptying them of ink and causing them to no longer function when needed.

Various systems have been devised to provide the appropriate backpressure. One reliable such system uses a fluid holding member 106, which may include, for example, a porous material, such as synthetic foam, to provide backpressure by capillary action. In other implementations, fluid holding member 106 may include other types of capillary force providing structures such as, for example, a body of bonded polyester fibers or the like.

While this example is drawn to a print cartridge that will be used on-axis, the various methods and apparatuses provided herein are clearly adaptable to off-axis printing devices, and to other non-printing fluid storage and/or fluid delivery devices or the like.

FIG. 1B shows two exemplary housings 102, as in FIG. 1A, illustrating two different exemplary fluid conduits 112 and 112' within chamber 104. These two simple examples illustrate that the fluid conduit may take different shapes and/or have different sizes. Here, fluid conduit 112 and fluid opening 114 have non-circular shapes when viewed from above, while fluid conduit 112' and fluid opening 114' have more circular shapes when viewed from above.

FIG. 1C is an illustrative cross-sectional diagram of the assembled fluid container 100 in the form of a print cartridge of FIG. 1A. Here, fluid holding member 106 is arranged within chamber 104. Lid 108 is attached to housing 102. Fluid ejection mechanism 118 is operatively coupled to an external surface 130 of housing 102 and/or fluid conduit 112 such that a fluid 124 may be selectively drawn from fluid holding member 106 and ejected using nozzles 120.

Fluid holding member 106 contacts filter 116 as illustrated by the compressed and bulging protrusions above air pocket 122. For illustrative purposes, an air space 136 is shown within chamber 104 between fluid holding member 106 and lid 108. Air space 136 may be optional and formed or otherwise maintained by protrusions or the like (not shown) associated with lid 108, housing 102 and/or fluid holding member 106. Air within air space 136 is fluidically coupled via air vent 108 to atmosphere 134, which is located external to container 100.

As illustrated in this example, at least one air pocket 122 is defined within chamber 104 below fluid holding member 106 and between an interior surface 132 (see FIG. 1A) of housing 102 and fluid conduit 112. In this example, when fluid conduit 112 is shaped according to FIGS. 1A-B, a single air pocket 122 surrounds fluid conduit 112/112' in the lower portion of chamber 104 when fluid holding member 106 is arranged therein.

Fluid holding member 106 may, for example, be arranged such that there is some compression with fluid conduit 112 and/or filter 116. This is illustrated in the drawings by the slight bulging of fluid holding member 106 about filter 116 and above air pocket 122. Such compression is known to increase the capillarity provided by fluid holding member 106 in a region nearby or otherwise adjacent to filter 116.

In FIG. 1C, fluid holding member 106 is further illustrated as being at least partially filled with fluid such that there is a wetted portion 126 adjacent to, or otherwise nearby, filter 116 within which fluid is being held. Such is well known to those skilled in the art. By way of example, a needle or other like (not shown) may be inserted into fluid holding member 106 and fluid introduced therethrough. Note that while wetted portion 126 is illustrated in the drawing as having an oval shaped cross-section, the actual shape will likely be much different. Other portions of fluid holding member 106 may be considered as "non-wetted" portions in that unlike wetted portion 126 such non-wetted portions hold little if any significant amounts of fluid. Instead, such non-wetted portions tend to hold air where fluid might otherwise be held.

As used herein the term non-wetted is not necessarily meant to require a certain level of dryness. Instead, the term "non-wetted" is intended to differentiate between two states that regions or portions of fluid holding member 106 may be in based on the presence or the lack of extractable levels of fluid. Thus, for example, while a fluid holding member may contain some type of fluid everywhere or nearly everywhere the "wetted" portion will include enough fluid to allow some fluid to be drawn through the fluid conduit for printing or the like as intended by design. Conversely, the "non-wetted" portions will not include enough fluid to allow some fluid to be drawn through the fluid conduit for printing or the like as intended by design. A wetted portion may therefore overtime become a non-wetted portion as a result of the fluid being drawn from it.

Another notable distinction is that, comparing equal volumes of the fluid holding member, a non-wetted portion will be more permeable to air than the wetted portion since at least some of the internal pathways through the wetted portion will contain fluid.

As illustrated in the example of FIG. 1C, there is a non-wetted portion 128 located in this example above wetted portion 126. Accordingly, in this example, wetted portion 126 is substantially located between non-wetted portion 128 and filter 116. Wetted portion 126 may present an impediment to air flow between air pocket 122 and air vent 110 through non-wetted portions. Unfortunately, in certain implementations such an impediment to air flow may lead to unwanted pressure being applied to portions of fluid holding member 106, which tends to change the fluid holding properties of fluid holding member 106.

The unwanted pressure may be caused by pressure differences between air pocket 122 and atmosphere 134. For example, changes in altitude during shipping may cause the air pressure of atmosphere 134 to be significantly lower than the air pressure of the air within air pocket 122. In another example, changes in temperature of the air within air pocket 122 may result in a pressure difference. While in these two examples the pressure difference occurs because the air pressure of the air within air pocket 122 is higher than the atmospheric air pressure, it is recognized that the pressure difference may occur because the air within air pocket 122 is lower than the atmospheric air pressure. However it occurs, such a pressure difference may cause fluid 124 to drool or otherwise leak out of nozzles 120.

Thus, in accordance with certain aspects of the present invention, one or more novel features are provided to reduce restriction of air flowing between vent 110 and air pocket 122.

Figure 2:
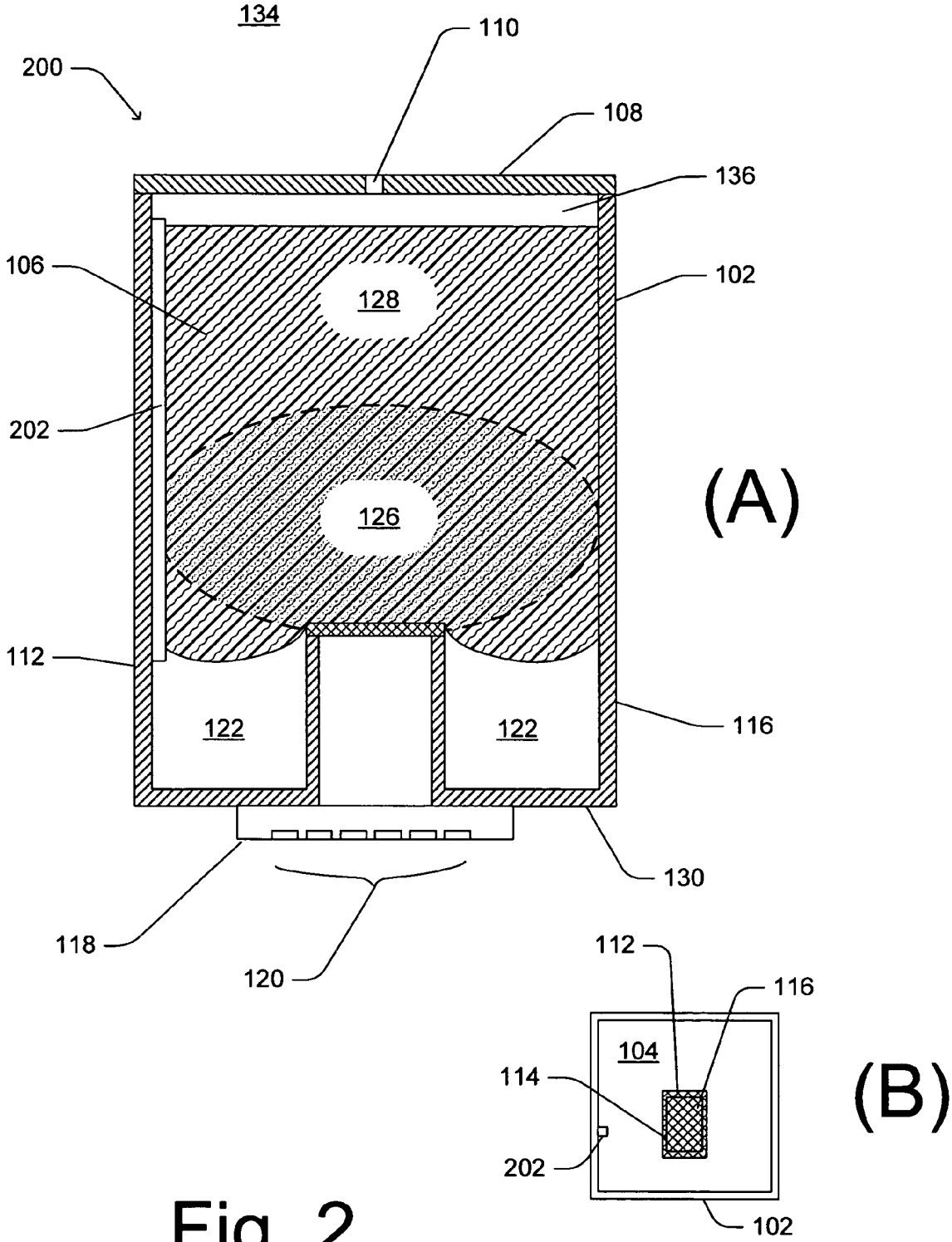
FIG. 2A is an illustrative cross-sectional diagram of an assembled fluid container in the form of a print cartridge having at least one feature that provides an air passageway in accordance with certain implementations of the present invention.
FIG. 2B shows the fluid container, as in FIG. 2A, having at least one feature that provides an air passageway in accordance with certain implementations of the present invention.

Attention is now drawn to FIG. 2A, which is an illustrative cross-sectional diagram of an assembled fluid container 200 in the form of a print cartridge similar to fluid container 100, but also having at least one feature 202 that provides a less restrictive air path at least part of the way between vent 110 and air pocket 122, in accordance with certain implementations of the present invention. Feature 202 allows for air to flow between vent 110 and air pocket 122 without being significantly impeded along the way by the presence of fluid in wetted portion 126. This improved air flow capability tends to avoid significant pressure differences that might otherwise lead to unwanted fluid release through nozzles 120. FIG. 2B is a view into chamber 104 of housing 102 of container 200 prior to assembly showing feature 202.

Figure 3:
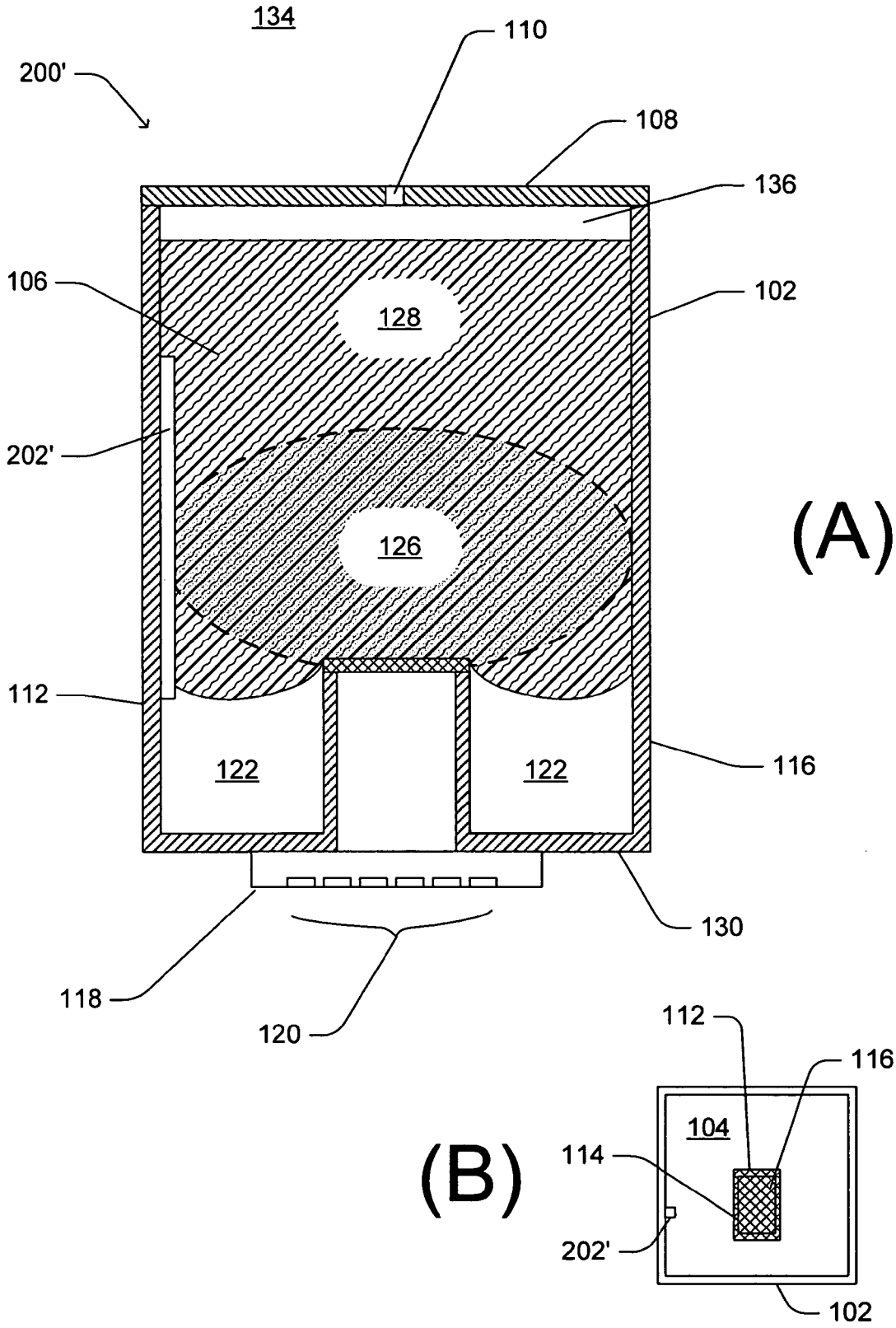
FIG. 3A is an illustrative cross-sectional diagram of an assembled fluid container in the form of a print cartridge having at least one feature that provides an air passageway in accordance with certain other implementations of the present invention.
FIG. 3B shows the fluid container, as in FIG. 3A, having at least one feature that provides an air passageway in accordance with certain implementations of the present invention.

Attention is now drawn to FIG. 3A, which is an illustrative cross-sectional diagram of an assembled fluid container 200' in the form of a print cartridge similar to fluid container 100, but also having at least one feature 202' that provides a reduced restriction air path at least part of the way between non-wetted portion 128 and air pocket 122, in accordance with certain other implementations of the present invention. Feature 202' allows for air to flow between non-wetted portion 128 and air pocket 122 without being significantly impeded along the way by the presence of fluid in wetted portion 126. In this example, air is permitted to flow between air pocket 122 and air vent 110 through at least part of non-wetted portion 128 and air space 136 (if present). The resulting improved air flow capability tends to avoid significant pressure differences that might otherwise lead to unwanted fluid release through nozzles 120. FIG. 3B is a view into chamber 104 of housing 102 of container 200' prior to assembly showing feature 202'.

FIGS. 4A-F are illustrative cross-sectional diagrams depicting in close-up view some exemplary features 202*a-f*, respectively, that may be used to provide one or more air passageways 400 in fluid containers such as fluid containers 200 and/or 200', in accordance with certain implementations of the present invention.

Figure 4:
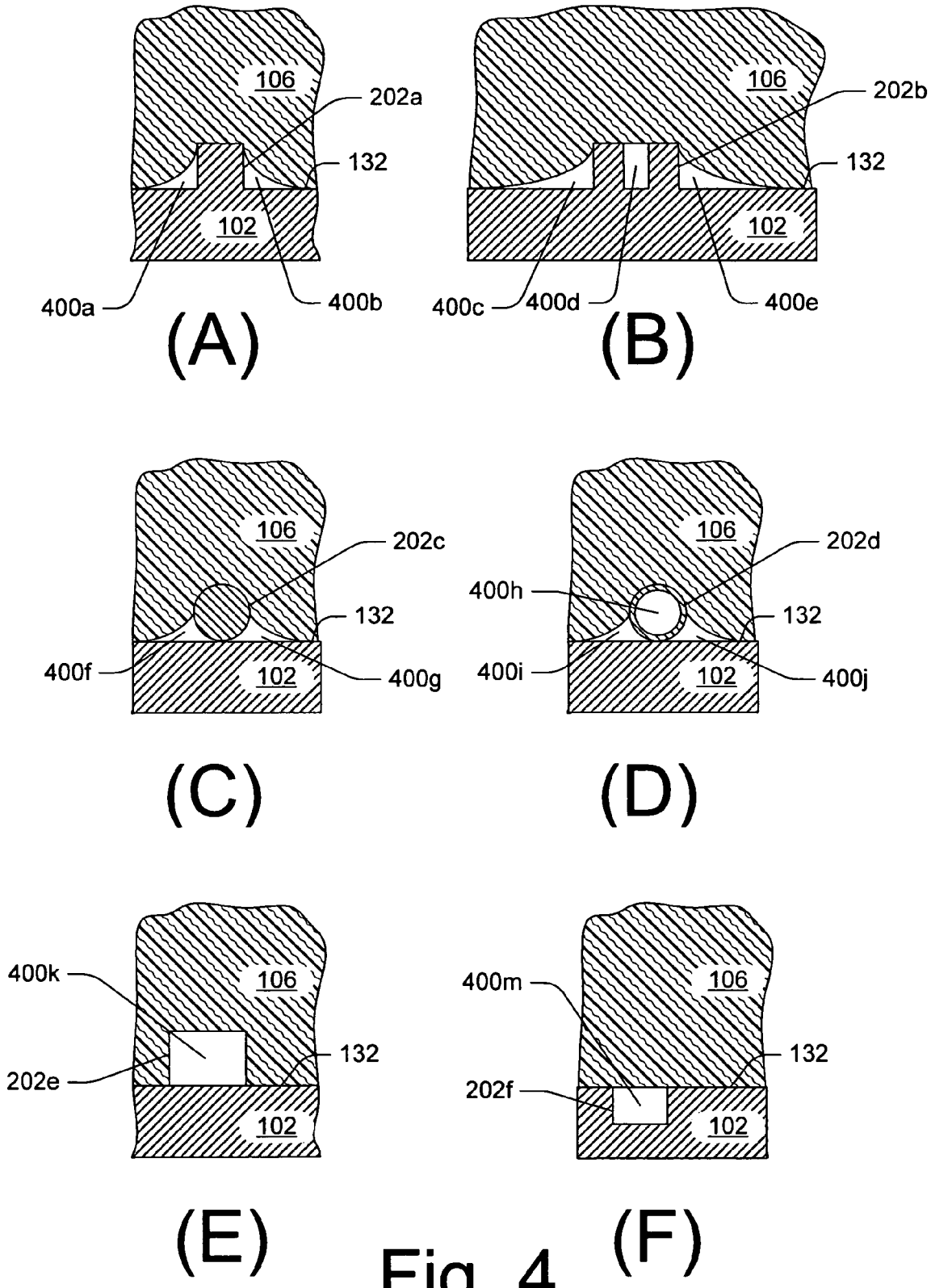
FIGS. 4A-F are illustrative close-up diagrams depicting in cross-sectional views some exemplary types of features that may be used to provide air passageways in fluid containers, such as those in FIG. 2A and/or FIG. 3A, in accordance with certain implementations of the present invention.

In FIG. 4A, housing 102 includes at least one rib feature 202*a* of internal surface 132. Rib feature 202*a* extends into chamber 104 and contacts fluid holding member 106 in a manner that deforms or otherwise alters fluid holding member 106 such that at least one air passageway 400 is formed between internal surface 132 and fluid holding member 106. Here, by way of example, rib feature 202*a* has deformed fluid holding member 106 enough to create two air passageways 400*a* and 400*b*. Air passageways 400*a-b* promote air exchange between air pocket 122 and atmosphere 134, as previously described.

In FIG. 4B, housing 102 includes at least one multiple rib feature 202*b* of internal surface 132. Multiple rib feature 202*b* extends into chamber 104 and contacts fluid holding member 106 in a manner that deforms or otherwise alters fluid holding member 106 such that at least one air passageway 400 is formed between internal surface 132 and fluid holding member 106. Here, by way of example, multiple rib feature 202*b* includes two spaced apart ribs that deform fluid holding member 106 enough to create three air passageways (400*c*, 400*d* and 400*e*) to promote air exchange between air pocket 122 and atmosphere 134, as previously described.

In FIG. 4C, at least one elongated member feature 202*c* is arranged between internal surface 132 and fluid holding member 106. In this example, elongated member feature 202*c* is within chamber 104 and contacts fluid holding member 106 in a manner that deforms or otherwise alters fluid holding member 106 such that two air passageways 400*f* and 400*g* are formed to promote air exchange between air pocket 122 and atmosphere 134, as previously described. In certain implementations, for example, elongated member feature 202*c* includes a wire that is inserted or otherwise configured within fluid container 200/200'.

In FIG. 4D, at least one tubular member feature 202*d* is arranged between internal surface 132 and fluid holding member 106. In this example, tubular member feature 202*d* is hollow or otherwise air permeable to provide an air passageway 400*h* therethrough. Also, in this example, tubular member feature is further arranged within chamber 104 to contact fluid holding member 106 in a manner that deforms or otherwise alters fluid holding member 106 such that two additional air passageways 400*i* and 400*j* are formed to further promote air exchange between air pocket 122 and atmosphere 134, as previously described.

In FIG. 4E, at least one fluid holding member channel feature 202*e* is provided by fluid holding member 106. Channel feature 202*e* forms an air passageway 400*k* when arranged adjacent to internal surface 132 to promote air exchange between air pocket 122 and atmosphere 134, as previously described.

In FIG. 4F, internal surface 132 defines at least one housing channel feature 202*f*. Channel feature 202*f* forms an air passageway 400*m* when arranged adjacent to fluid holding member 106 to promote air exchange between air pocket 122 and atmosphere 134, as previously described.

The preceding description has been presented only to illustrate and describe embodiments of the invention. It is not intended to be exhaustive or to limit the invention to any precise form disclosed. Many modifications and variations are possible in light of the above teaching.

What is claimed is:

1. A container comprising:

a housing forming at least one chamber therein;

a fluid conduit extending into said chamber, said fluid conduit having a fluid opening;

a fluid holding member arranged within said chamber over said fluid opening, said fluid holding member leaving at least one air pocket within said chamber adjacent to said fluid conduit, and wherein when at least partially filled with a fluid said fluid holding member includes a wetted portion and a non-wetted portion, said wetted portion being fluidically coupled to said fluid conduit; and at least one feature within said chamber forming an air passageway that allows air movement between said air pocket and at least said non-wetted portion.

2. The container as recited in claim 1, further comprising:

an air vent coupling at least part of said non-wetted portion to an atmosphere external to said housing to allow air movement between said atmosphere and said non-wetted portion.

3. The container as recited in claim 2, wherein said non-wetted portion is substantially located between said wetted portion and said air vent.

4. The container as recited in claim 1, wherein said housing forms an opening, and further comprising:

a lid attached to said housing over said opening.

5. The container as recited in claim 4, wherein an air vent extends through said lid, said air vent coupling at least part of said non-wetted portion to an atmosphere external to said housing to allow air movement between said atmosphere and said non-wetted portion.

6. The container as recited in claim 1, wherein said fluid opening of said fluid conduit includes a filter extending across said fluid opening.

7. The container as recited in claim 1, wherein said feature contacts and deforms part of said fluid holding member to form at least a portion of said air passageway.

8. The container as recited in claim 1, wherein said housing includes an interior surface defining at least a portion of said chamber, said feature comprising at least one rib feature extending into said chamber from said internal surface, said rib feature deforming a part of said fluid holding member to form at least a portion of said air passageway.

9. The container as recited in claim 1, wherein said housing includes an interior surface defining at least a portion of said chamber, said interior surface comprising at least one channel feature to form at least a portion of said air passageway.

10. The container as recited in claim 1, wherein said housing includes an interior surface defining at least a portion of said chamber, said feature comprising a channel feature formed in said fluid holding member adjacent said internal surface to form at least a portion of said air passageway.

11. The container as recited in claim 1, said feature comprising a tubular feature forming at least a portion of said air passageway therein.

12. The container as recited in claim 1, wherein said housing includes an interior surface defining at least a portion of said chamber, said feature comprising an elongated member feature arranged between said fluid holding member and said internal surface and deforming a part of said fluid holding member to form at least a portion of said air passageway.

13. The container as recited in claim 1, further comprising a fluid ejection mechanism fluidically coupled to said fluid conduit.

14. The container as recited in claim 13, wherein said fluid ejection mechanism is located on an exterior surface of said housing.

15. The container as recited in claim 1, wherein said fluid holding member includes a foam and said fluid includes a printing fluid.

16. A method comprising:

providing a container having a fluid holding member arranged within a chamber therein, said fluid holding member containing fluid in a wetted portion and substantially less fluid in a non-wetted portion, wherein said arrangement of said fluid holding member leaves at least one air pocket within said chamber adjacent to a fluid conduit that extends into said chamber; and forming an air passageway that allows air movement between said air pocket and at least said non-wetted portion.

17. The method as recited in claim 16, further comprising:

coupling at least part of said non-wetted portion to an atmosphere external to said container to allow air movement between said atmosphere and said non-wetted portion.

18. The method as recited in claim 16, wherein forming said air passageway includes causing at least one rib feature extending into said chamber from an internal surface of said container to deform a part of said fluid holding member to form at least a portion of said air passageway.

19. The method as recited in claim 16, wherein forming said air passageway includes providing an interior surface defining at least a portion of said chamber, said interior surface comprising at least one channel feature to form at least a portion of said air passageway.

20. The method as recited in claim 16, wherein forming said air passageway includes providing an interior surface defining at least a portion of said chamber, said feature comprising a channel feature formed in said fluid holding member adjacent said internal surface to form at least a portion of said air passageway.

21. The method as recited in claim 16, wherein forming said air passageway includes using a tubular feature to form at least a portion of said air passageway therein.

22. The method as recited in claim 16, wherein forming said air passageway includes providing an elongated member feature arranged between said fluid holding member and an internal surface of said container to deform a part of said fluid holding member to form at least a portion of said air passageway.

* * * * *